US005408706A

United States Patent [19]

Barnes

[11] Patent Number: 5,408,706

[45] Date of Patent: Apr. 25, 1995

[54] FITTING ASSEMBLY FOR VINYL LINED POOLS

[75] Inventor: Steven R. Barnes, Phoenix, Ariz.

[73] Assignee: Caretaker Systems, Inc., Scottsdale, Ariz.

[21] Appl. No.: 106,404

[22] Filed: Aug. 13, 1993

[51] Int. Cl.[6] ..... E03F 5/04

[52] U.S. Cl. ..... 4/507; 4/506; 210/163; 210/165

[58] Field of Search ..... 4/488, 492, 496, 498, 4/503, 504, 506, 507, 292, 580, DIG. 18, 584, 585, 490; 52/169.5; 210/163, 164, 165, 166, 169

[56] References Cited

U.S. PATENT DOCUMENTS

| | | | |
|---|---|---|---|
| 2,749,999 | 6/1956 | Schmid | 210/165 |
| 2,837,212 | 6/1958 | Schmid | 210/165 |
| 3,578,023 | 5/1971 | Diemond et al. | 4/507 |
| 3,749,424 | 7/1973 | Greene | 4/507 |
| 3,868,732 | 3/1975 | Engelhart | 4/496 |
| 4,457,119 | 7/1984 | Dahowski | 4/506 |
| 4,505,814 | 3/1985 | Marshall | 210/166 |
| 4,561,134 | 12/1985 | Mathews . | |
| 4,910,811 | 3/1990 | Izzi, Sr. | 210/163 |
| 5,268,096 | 12/1993 | Robol | 4/507 |

FOREIGN PATENT DOCUMENTS

| | | | |
|---|---|---|---|
| 1227837 | 3/1960 | France | 4/503 |

*Primary Examiner*—Henry J. Recla
*Assistant Examiner*—Gregory M. Vidovich
*Attorney, Agent, or Firm*—LaValle D. Ptak

[57] ABSTRACT

A fitting assembly for use in swimming pools, spas, and the like with vinyl liners, comprises a fitting member which is mounted in an opening in the wall of the pool, either flush with the pool wall or with a flange extending over the interior of the pool wall near the opening. The fitting member has a recess in it about its periphery. The vinyl liner then is placed over the fitting member; and a clamp member, which has a predetermined thickness not greater than the depth of the recess, is secured in the recess of the fitting member over the vinyl liner to clamp the vinyl liner between the clamp and the recess of the fitting member. This provides a flush mount or nearly flush mount of the fitting member with the vinyl liner of the pool.

9 Claims, 2 Drawing Sheets

FITTING ASSEMBLY FOR VINYL LINED POOLS

BACKGROUND

Swimming pools and spas enjoy widespread popularity in many parts of the world. Such pools and spas are built in a wide variety of shapes, and with a number of different construction techniques. The most expensive installations, and the ones considered the most aesthetically appealing, are "in-ground" pools. Such pools first require an excavation to be made in the rough dimensions of the pool. Following the initial excavation of the hole in which the pool is to be placed, different steps are taken, depending upon the particular type of pool construction which is to be employed.

The two most common types of in-ground pools have interior finishes made of either a masonry type finish, plaster, marcite, exposed aggregate, etc. or a vinyl liner finish.

The masonry finished pool has, historically had advantages over the vinyl lined pool in aesthetics and ease of cleaning. All pools have inlets and outlets to facilitate the circulation and cleaning of the pool. In a masonry finished pool, these inlets can be installed flush with the interior surface of the pool because the masonry finish seals against the outside of the fittings. In contrast, the vinyl fittings must clamp the vinyl liner material to facilitate sealing. Typically, this clamping required a part to be installed on the surface of the liner, which stands off the interior surface of the pool. These fittings typically are made of white plastic and held in place by steel screws, all of which increase the visibility of the fittings. In addition to the visibility problem, the part standing above the interior surface tends to catch debris and pose an obstacle to swimmers and robotic cleaning devices. These problems give vinyl pools a perceived lesser value compared to masonry pools with flush mounted fittings.

In the installation of a vinyl liner for a swimming pool or spa, the liner has no pre-formed openings in it. Consequently, when it is in place it covers the drain, returns, cleaning fitting openings, skimmer openings, etc. As a result, it is necessary to secure the vinyl liner around these openings and then cut the liner in appropriate shapes for each of the different inlets or outlets to the pool, which ultimately will be beneath the water level of the pool when it is filled.

In typical installations, prior to the water level reaching the various openings in the pool, a face plate first is secured to the fitting, which projects a short distance beyond the pool wall after the vinyl is stretched in place over the fitting opening. Because the vinyl is under considerable tension over many of these openings, it is not possible to cut a hole in the vinyl first and then apply a securing face plate over the opening. The attachment of the face plate or cap over each of the openings must be made while the vinyl is still stretched across the opening. Typically, this is accomplished by first placing a gasket around the short projection of the fitting or pipe (either under or over the vinyl). The face plate then is screwed into mating holes in the fitting behind the vinyl to secure everything in place. The result is that the face plate extends or projects into the pool, out from the surface (wall or bottom) of the vinyl. Although the projection of the face plate, which secures the vinyl to the fitting, is not significant, it can extend up to one-half inch beyond the vinyl wall or floor, particularly in the case of floor drain face plate securing rings.

Typical face plates are attached to the fittings by screwing the face plate into mating holes in the fitting behind the vinyl to secure everything in place. The screws (usually four or more) are driven through the vinyl into the holes behind it in the fitting to secure the face plate, a gasket (if one is used), vinyl and fitting together in a clamped sandwich. After the face plate has been secured, a sharp knife or razor blade is used to cut the vinyl liner material from inside the face plate; so that the opening is completed through the face plate to the communicating plumbing attached to the fitting. It is important that the screws are tightenned securely and evenly to prevent any subsequent leak of the water from the pool around the fitting and behind the vinyl and/or the pool wall or floor.

An improvement in fitting assemblies for vinyl lined pools is disclosed in U.S. Pat. No. 4,561,134 to Mathews et al. In the Mathews patent, the face plate is not secured by means of screws, but includes a fitting member with a flange on it for engaging the wall surface around the opening on the inside of the pool. The flange has a set of notches or keys in it for facilitating alignment of a face plate cap, which in turn has an opening through it, designed to align with a corresponding opening through the fitting member. The face plate cap is pressed toward the flange on the fitting member, and is located by mating projections or depressions, which align with the notches or keys on the flange to hold it in place. The vinyl liner in the opening then is cut away and a final retaining ring is threaded into the threaded interior of the fitting to press the face plate into tight engagement with the vinyl and the flange on the fitting member to hold everything in place. The fitting assembly of this patent, however, still has the face plate cap extending out into the pool beyond the wall surface formed by the vinyl liner. This protrusion may be contacted by swimmers or persons using the pool, and also permits dirt deposits to be formed around it.

It is desirable to provide an effective, simple, flush mounted installation of face plates for fittings in vinyl pool constructions.

SUMMARY OF THE INVENTION

Accordingly, it is an object of this invention to provide an improved fitting assembly for vinyl lined pools.

It is another object of this invention to provide an improved fitting assembly for vinyl lined pools, which is simple to install.

It is an additional object of this invention to provide a fitting assembly for vinyl lined pools which improves the appearance of the finished pool.

It is a further object of this invention to provide an improved fitting assembly for vinyl lined pools which produces a flush mounted, or nearly flush mounted, fitting in such pools.

In accordance with a preferred embodiment of this invention, an improved fitting assembly for use in conjunction with pools having a vinyl liner includes a fitting member mounted in a opening in a wall of the pool. The fitting member has a recess about its periphery. A clamp member, which has a thickness which is not greater than the depth of the recess in the fitting member, is constructed to be secured in the recess of the fitting member after a vinyl liner is placed over the fitting member. When the clamp member is secured in the recess, it sandwiches the vinyl liner between the clamp member and the recess of the fitting member.

DETAILED DESCRIPTION

Reference now should be made to the drawings, in which the same reference numbers are used throughout the different figures to designate the same or similar components.

Figure 1:
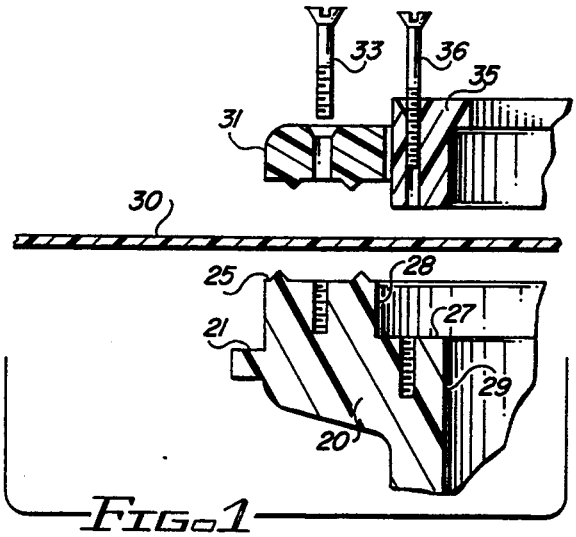
FIG. 1 (PRIOR ART)
FIG. 1 is an exploded partial cross-sectional view of a typical prior art fitting assembly.
Figure 2:
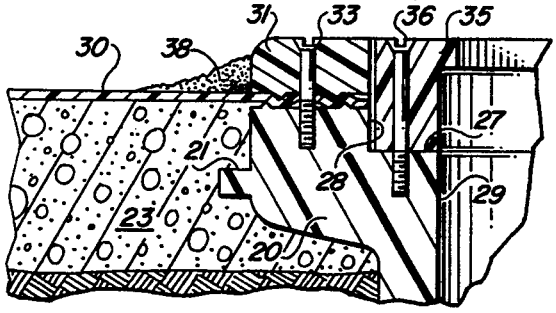
FIG. 2 (PRIOR ART)
FIG. 2 is an assembled partial cross-sectional view of the prior art fitting assembly of FIG. 1.

FIGS. 1 and 2 illustrate a typical prior art installation of a fitting for a vinyl lined pool. In FIG. 1, the various components are shown in exploded form; and in FIG. 2 the same components are shown in the form that they take in a finished pool assembly. As illustrated in FIG. 1, the fitting itself, which is embedded in the pool wall or floor, comprises a main body portion 20. As illustrated in FIG. 2, this body portion 20 may be formed into a concrete wall or floor 23 for the pool. Typically, the components which are shown in FIG. 1 are in the form of circular fittings, caps and the like. Since these fittings are symmetrical, only a portion has been shown in each of these figures, which represent cross-sectional side views taken along a plane through the central longitudinal axis of the fitting.

The fitting 20 includes a cylindrical central opening 29, which typically is connected to a supply pipe, return pipe or drain pipe, depending upon the use which is to be made of the fitting. Since the pipe connections to the fitting are conventional connections, made in conjunction with pools and spas, those connections are not shown in any of the figures, including FIGS. 1 and 2, since they are well known. The cylindrical hollow pipe-like portion 29 of the fitting 20 may be either threaded onto the end of a pipe (not shown) or secured to a pipe by means of a suitable standard adhesive.

When the fitting 20 is placed in the concrete wall 23 of a pool, its upper surface typically is finished flush with the upper surface of the wall of the pool, as shown in FIG. 2. To assist in securing the fitting 20 in the concrete 23 of the pool, an outwardly extending anchoring flange 21 is provided. The fitting also includes an enlarged circular opening defined by a vertical wall 28 and a shoulder 27, into which a drain grate 35 or other component subsequently may be mounted.

For installation in a vinyl pool, a vinyl liner 30 is stretched completely over the fitting, as illustrated in the exploded view of FIG. 1, completely covering the circular opening 28 and the internal circular opening 29 in the fitting 20. After the vinyl liner sheet 30 has been stretched into place, a securing ring 31 is pressed over the vinyl sheet 30 and is secured by means of screws 33 extending through the vinyl and threaded into corresponding tapped holes in the body of the fitting 20. Ridges or corrugations on the upper surface of the fitting 20 and the lower surface of the ring 31 help to secure the vinyl sheet 30 in place, as is readily apparent from an examination of FIG. 2. As explained previously, after the vinyl sheet 30 is clamped into place by means of the ring 31, the vinyl is cut around the periphery of the opening 28. After this has been done, the grate 35 then is secured onto the fitting 28 by means of screws 36 extending into tapped holes in the shoulder 27, as illustrated in FIG. 2.

As is readily apparent from an examination of FIG. 2, the ring 31 extends above the upper surface (as illustrated in FIG. 2) or the inner wall of the pool formed by the vinyl liner 30. This permits an accumulation of dirt 38 to form in the discontinuity between the vinyl liner wall 30 and the ring 31. For floor drains and the like, the ring 31 can have a substantial thickness, up to one inch. Not only is it possible for dirt 38 to accumulate around the ring 31, the ring also may be struck by the toes or other body parts of swimmers using the pool or spa. The smooth or flush appearance, which typically is achieved for plaster finished pools, consequently is not achieved for vinyl lined pools, because of the use of fittings of the type shown in the prior art example of FIGS. 1 and 2.

Figure 7:
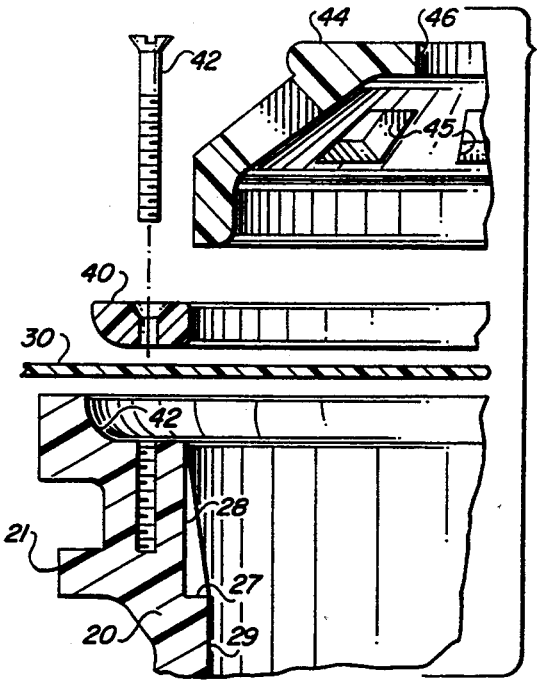
FIG. 7 is an exploded cross-sectional view of another embodiment of the invention.
Figure 8:
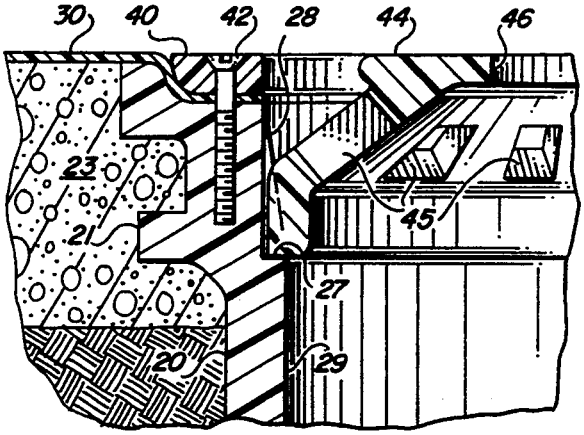
FIG. 8 is a cross-sectional assembled view of the embodiment of FIG. 7.

Reference now should be made to FIGS. 7 and 8, which illustrate a preferred embodiment of the invention for producing a flush mounted floor drain or the like for a vinyl lined pool. FIGS. 7 and 8 also are partial cross-sectional views of circular fittings, and the portions of these fittings which are similar to the fittings of FIGS. 1 and 2 are provided with the same reference numbers and function in the same manner described for those prior art fittings. The main body of the fitting 20, with the projection 21, is embedded in the concrete wall or floor 23 of the pool, as illustrated in FIG. 8. This is done in essentially the same manner as illustrated for the prior art fitting 20 of FIG. 2. The fitting 20, however, of the preferred embodiment of the invention, shown in FIGS. 7 and 8, has a circular recess 42 formed in it. This recess 42 is spaced inwardly from the outer periphery of the top surface of the fitting 20, as clearly illustrated in both FIGS. 7 and 8.

The vinyl liner 30 is stretched completely over the circular opening comprised by the recess 42, the wall 28 and the pipe opening 29 in the same manner described above. This is illustrated in FIG. 7.

To secure the vinyl liner 30 in place, a retaining ring or clamp 40 in the form of an open circular ring, and having a configuration on its underside which corresponds to the shape of the recess 42, is pressed into place into the position shown in FIG. 8. The thickness of the ring 40 is selected to be equal to the depth of the recess 42. The clamp or ring 40 is secured in place by means of screws 42, which are threaded into the fitting 20 in the same manner as the screws 33 of the prior art embodiment shown in FIGS. 1 and 2 are threaded into the fitting 20. The ring 40 then presses the vinyl liner in place into the configuration shown in FIG. 8.

Once the vinyl liner 30 is secured in place by means of the ring 40, the portion which covers the opening 28 is cut away to permit a grate 44 to be put in place and rest on the shoulder 27. The grate 44 has holes 46 in its top surface, and is selected to extend downwardly onto the shoulder 27 with a number of apertures or openings 45 about the sloped outer edge, as shown in FIGS. 7 and 8. The particular configuration of the grate 44, however, is not important, and one having the configuration of the grate 35 could be used equally as well. The downwardly extending outer edge or flange of the grate 44 of FIGS. 7 and 8 permits it to be installed without using screws to hold it in place.

It should be noted, from an examination of FIG. 8, that the upper surface of the clamp or retaining ring 40 is in the same plane as the surface of the vinyl liner 30, which faces the interior of the pool. Typically, the upper surface of the grate 44 also lies in this plane; so that a flush mounted vinyl liner fitting assembly is achieved.

The vinyl liner 30 is pressed inwardly (downwardly as shown in FIGS. 7 and 8) by the clamping ring 40 when the ring is secured in place; so that the portion of the liner 30 which is clamped under the ring 40 is in a plane which is offset from the plane of the main portion of the vinyl liner 30. This also assists in pulling the vinyl liner 30 tightly into place, and reduces the possibility of tearing the liner at the point where it is penetrated by the screws 42.

Figure 3:
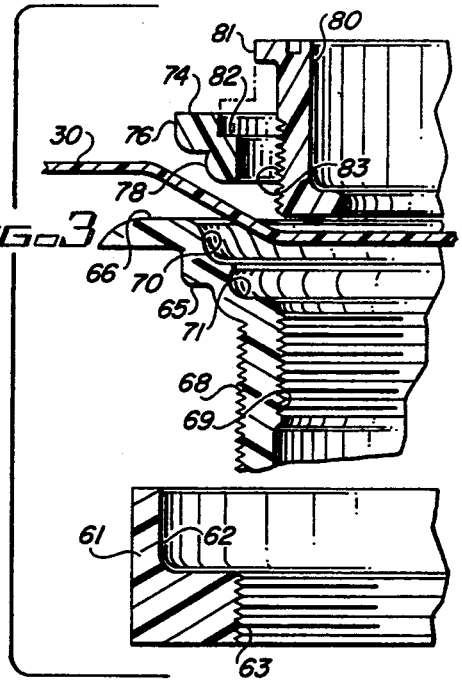
FIG. 3 is a partial cross-sectional exploded view of a preferred embodiment of the invention.
Figure 4:
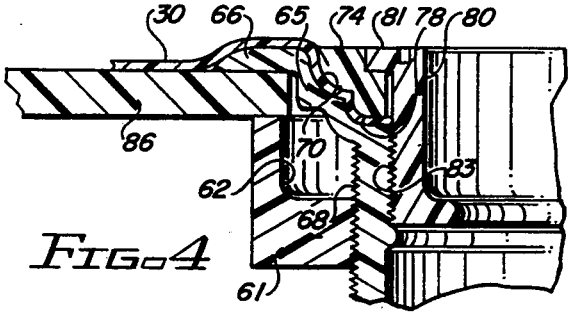
FIG. 4 is a cross-sectional assembled view of the embodiment of FIG. 1.
Figure 9:
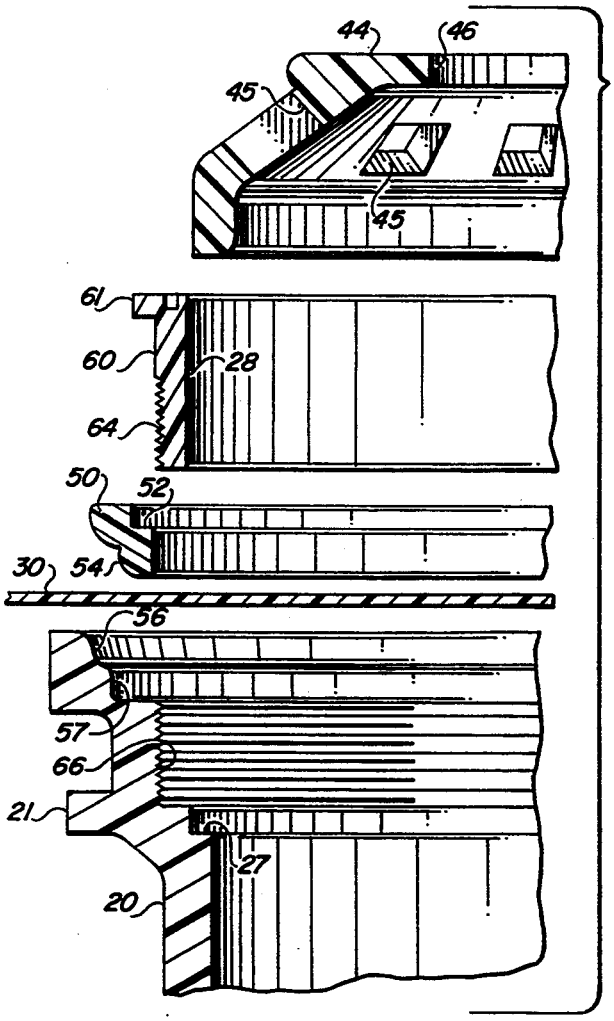
FIG. 9 is an exploded cross-sectional view of another embodiment of the invention which is a variation of the embodiment of FIGS. 7 and 8.
Figure 10:
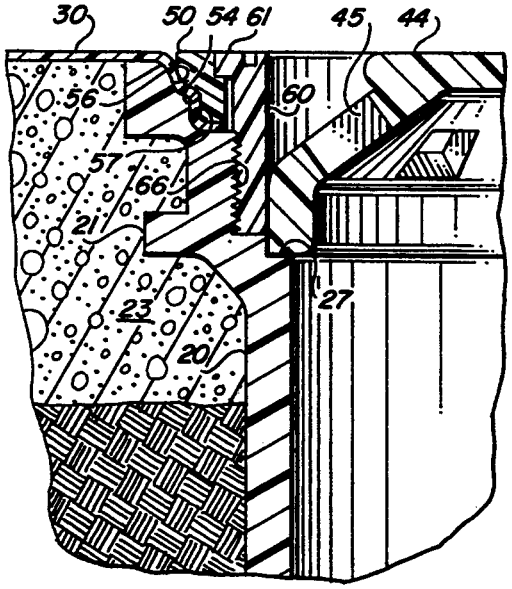
FIG. 10 is a cross-sectional assembled view of the embodiment of FIG. 9.

FIGS. 9 and 10 illustrate a variation of the assembly of FIG. 8, in which the screws 42, which penetrate through the vinyl liner 30 and the ring 40, are not used. The assembly which is illustrated in FIGS. 9 and 10 uses some of the principles of the fitting assembly of the aforementioned U.S. Pat. No. 4,571,134. The fitting assembly of FIGS. 9 and 10 uses one additional part, as part of the assembly, in order to eliminate the screws 42. In addition, the retaining ring 40 has been replaced with a retaining ring 50 having a somewhat different configuration. The fitting 20 is formed with a two-step circular recess having an outer or upper portion 56, which is similar in shape to the curved outer portion of the recess 42 of the embodiment shown in FIGS. 7 and 8. Stepped downwardly from this portion 56 is an inwardly curved recessed portion 57. The retaining ring 50 illustrated in FIGS. 9 and 10 also has a two-step outer configuration, with a projection 54 arranged to form a snap-tight fit into the circular recess 57 in the housing 20. Immediately below the recess 57 in the housing 20 is an internally threaded region 66, which is stepped inwardly from the shoulder 27. In assembling the fitting of FIG. 9, the steps mentioned above in conjunction with stretching the vinyl liner 30 over the opening in the fitting 20 once again are repeated. Once this is done, the ring 50 is pressed into place to "snap-fit" the vinyl liner into the stepped recess 56/57 as shown in the assembled view of FIG. 10. Once the ring 50 is in place, the vinyl liner 30 is cut around the periphery of the open bottom portion of the retaining ring clamp 50 in the same manner described above. A threaded insert 60, having external threads 64 which mate with the threads 66 in the fitting 20, then is threaded downwardly into the opening, as illustrated in FIGS. 9 and 10. An outwardly extending flange 61 at the top of the insert 60 overlies a corresponding shoulder 52 in the retaining ring 50; so that the flange 61 presses downwardly on the shoulder 52 to securely hold the retaining ring 50 in place, as shown in FIG. 10. Once this has been done, the grate 44 (or other return fitting or spa fitting) is then placed into the opening to rest on the shoulder 27, as described above in conjunction with FIGS. 7 and 8. FIGS. 3 and 4 illustrate a variation of the embodiment of FIGS. 9 and 10, but one which is used on a thin walled pool or spa. In place of a fitting 20, which is embedded in concrete as described above in conjunction with FIGS. 7 to 10, the fitting comprises two parts, one part 61 of which is located behind the thin wall 80 of the pool or spa (see FIG. 4) and another part 65 which fits over the internal side or water side of the pool. The part 61 which fits behind the pool has an internally threaded central opening. Once again, the embodiment shown in FIGS. 3 and 4 is for a circular fitting; so that only a partial cross-sectional view has been shown. The part 61 is placed behind a hole or opening in the wall 86 of the pool or spa. The fitting part 61 also has an enlarged relief recess portion 62, which is open toward the back side of the pool wall 86.

The second fitting part 65, which is both externally threaded at 68 and internally threaded at 69, then is threaded into the threads 63 of the fitting part 61 to clamp the two-part fitting around the opening through the wall 86, as illustrated in FIG. 4. The two fitting parts 61 and 65 are tightly secured together prior to the application of the vinyl liner 30 to the pool.

A flange 66 on the fitting part 65 overlies the wall 86 of the pool, as illustrated most clearly in FIG. 4. An internal recess, spaced inwardly from the outer periphery of the flange 66, is formed in a two-step arrangement 70 and 71 comparable to the two-step recess 56 and 57, previously described in conjunction with FIGS. 9 and 10. The vinyl liner 30 is stretched over the interior surface of the pool, and a clamping ring 74, having stepped outer mating projections 76 and 78 is snap-fit into place to clamp the vinyl liner between the clamping ring 74 and the recess 70, 71 in the fitting part 65 in the same manner described above in conjunction with the operation of the clamping ring 50 for FIGS. 9 and 10. After this has been done, the vinyl liner 30 is cut around the inner edge of the clamping ring 74.

The final step in assembly then is to thread an externally threaded insert 80 (having external threads 83) into the fitting part 65, to cause a flange 81 to press tightly downwardly onto a mating shoulder 82 in the clamping ring 74, as illustrated in FIG. 4. This securely holds the fitting assembly in place in a manner similar to that described above in conjunction with FIGS. 9 and 10. It should be noted that the vinyl liner 30 extends over the outside of the flange 66, which necessarily is above the surface 86 of the thin walled pool or spa. Typically, the thickness of the flange 66 is of the order of $\frac{1}{8}$th inch. The portion of the vinyl liner 30 which is stretched across this flange 66 is not perfectly flush with the remainder of the liner 30, which presses against the wall 86 of the pool; but the discontinuity is so slight that for all practical purposes, it provides a flush appearance to users of the pool.

Figure 5:
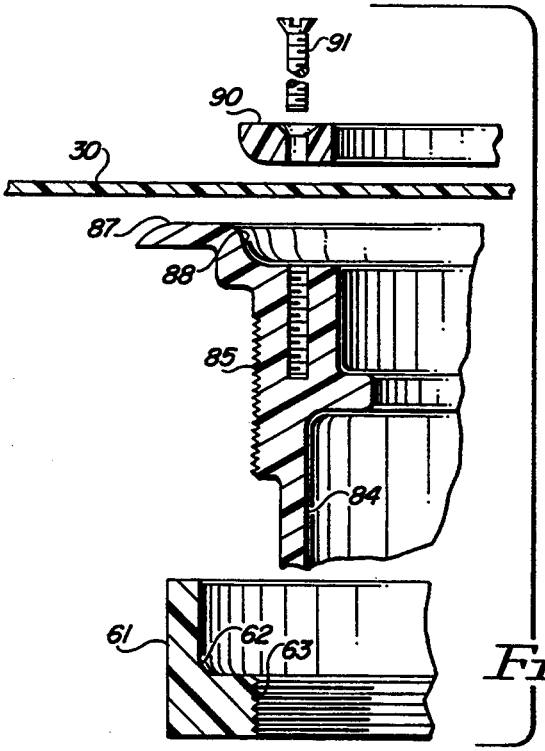
FIG. 5 is an exploded partial cross-sectional view of another embodiment of the invention.
Figure 6:
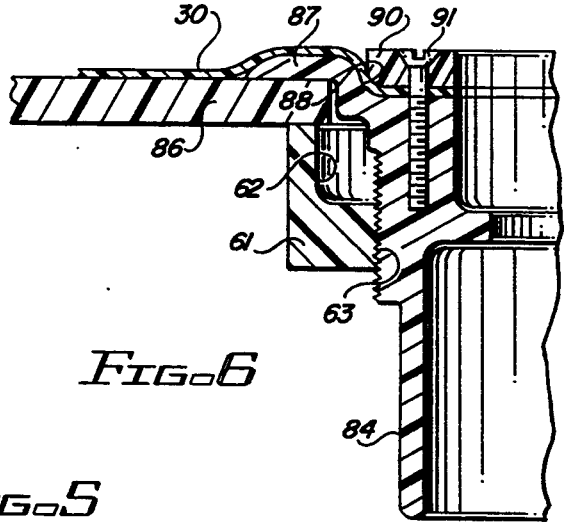
FIG. 6 is a cross-sectional assembled view of the embodiment of FIG. 5.

FIGS. 5 and 6 illustrate a variation of the embodiment of FIGS. 3 and 4, but one which uses a retaining ring and screw assembly similar to the retaining ring and screw assembly described above in conjunction with FIGS. 7 and 8. The retaining ring part 61, which is located behind the wall 86 of the pool, is used in the embodiment of FIGS. 5 and 6 in the same manner as described above in conjunction with the embodiment of FIGS. 3 and 4. The fitting part 65, however, is replaced with a slightly different fitting part 84, which is externally threaded at 85 to mate with the threads 63 and clamp a flange 87 over the inside surface of the wall 86 adjacent the opening into which the fitting is placed. Thus, the flange 87 extends over the wall 86 in the same manner that the flange 66 of FIGS. 3 and 4 extends over the wall 86. A circular recess 88, however, which is comparable to the recess 42 of FIGS. 7 and 8, is formed about the periphery of the fitting part 84 in place of the two-step recess 70, 71 of the embodiment shown in FIGS. 3 and 4. Tapped holes are provided throughout the body of the fitting part 84 in communication with this recess; so that when a vinyl liner 30 is stretched across the opening, a clamping ring or retaining ring 90 may be pressed into place over the vinyl ring 30 and secured in place by means of screws 91, as illustrated in FIG. 6. The manner of attachment of the retaining ring or clamping ring 90 is the same as the attachment of the ring 40 described above in conjunction with FIGS. 7 and 8.

Once the ring 90 is in place, the vinyl may be cut around the inner diameter of the ring; so that the structure which remains is assembled as illustrated in FIG. 6. Once again, the vinyl liner stretches over the outside of the flange 87 in the same manner in which it stretches over the outside of the flange 66 in the embodiment of FIGS. 3 and 4. As explained previously, the thickness of the flange 87 typically is of the order of $\frac{1}{8}$th inch; so that the overall appearance of the assembly which is shown in FIG. 6 essentially is of a flush mounted fitting in a vinyl lined pool. The slight step up (approximately $\frac{1}{8}''$), which occurs as a result of the use of the fittings of FIGS. 3 through 6, is a gradual one, which does not function to catch dirt and other debris.

The foregoing description of the preferred embodiment of the invention should be considered as illustrative and not as limiting. Modifications which employ substantially the same function, in substantially the same way, to achieve the same result, will occur to those skilled in the art without departing from the true scope of the invention as defined in the appended claims.

I claim:

1. A fitting assembly for use in conjunction with an opening through a pool wall having a vinyl liner, including in combination:

a fitting member having a top surface for mounting in an opening in a pool wall, said fitting member having an annular recess therein of a predetermined width and depth from the top surface thereof about the periphery thereof; and an annular clamp member having an upper surface of a width not greater than the width of said recess and having a predetermined thickness equal to said predetermined depth of the recess in said fitting member; and a securing member for securing said clamp member to said fitting member in the recess of said fitting member after a vinyl liner is placed over said fitting member for clamping said vinyl liner between said clamp member and said fitting member in the recess of said fitting member, such that the upper surface of said clamp member, said securing member and a top surface of said vinyl liner of said pool wall lie in the same plane.

2. The combination according to claim 1 wherein said fitting member comprises a circular drain for a swimming pool having an outer circular flange in which said recess is located, and having an open central portion therethrough, with the outer flange of said circular drain having an upper surface which is adapted to be mounted flush with the wall of a pool prior to placement of a vinyl liner therein.

3. The combination according to claim 2 wherein said securing member comprises threaded fasteners extending through said clamp member, a vinyl liner, and into said fitting member in the recess in said fitting member.

4. The combination according to claim 2 wherein said clamp member has a shoulder thereon, and said securing member comprises a sleeve having a flange extending therefrom, said sleeve extending into said fitting member with the flange of said sleeve on said securing member operating to press on the shoulder of said clamp member to press said clamp member into the recess in said fitting member.

5. The combination according to claim 1 wherein said fitting member has a flange for engaging the interior wall surface around the opening in the wall of said pool, with said flange being covered by a vinyl liner placed over said fitting member.

6. The combination according to claim 1 wherein said securing member comprises threaded fasteners extending through said clamp member, a vinyl liner, and into said fitting member in the recess in said fitting member.

7. The combination according to claim 1 wherein said clamp member has a shoulder thereon, and said securing member comprises a sleeve having a flange extending therefrom, said sleeve extending into said fitting member with the flange of said sleeve on said securing member operating to press on the shoulder of said clamp member to press said clamp member into the recess in said fitting member.

8. The combination according to claim 6 wherein said fitting member has a flange for engaging the interior wall surface around the opening in the wall of said pool, with said flange being covered by a vinyl liner placed over said fitting member.

9. A fitting assembly for use in conjunction with an opening through a pool wall having a vinyl liner, including in combination:

a fitting member having a top surface for mounting in an opening in a pool wall, said fitting member having an annular recess therein of a predetermined width and depth from the top surface thereof about the periphery thereof; and an annular clamp member having a predetermined thickness not greater than said predetermined depth of the recess in said fitting member and having a predetermined width not greater than said width of the recess in said fitting member, said clamp member adapted to be secured by means of threaded fasteners in the recess of said fitting member after a vinyl liner is placed over said fitting member for clamping said vinyl liner between said clamp member and said fitting member in the recess of said fitting member, said threaded fasteners extending through said clamp member and a top surface of said vinyl liner into said fitting member.

* * * * *